US006758000B2

(12) United States Patent
Sandt et al.

(10) Patent No.: US 6,758,000 B2
(45) Date of Patent: Jul. 6, 2004

(54) LIVESTOCK SECURITY TAG ASSEMBLY

(75) Inventors: Richard L. Sandt, Brunswick, OH (US); Mark D. Kittel, Berea, OH (US)

(73) Assignee: Avery Dennison Corporation, Pasadena, CA (US)

( * ) Notice: Subject to any disclaimer, the term of this patent is extended or adjusted under 35 U.S.C. 154(b) by 157 days.

(21) Appl. No.: 09/758,086

(22) Filed: Jan. 10, 2001

(65) Prior Publication Data

US 2002/0088154 A1 Jul. 11, 2002

(51) Int. Cl.[7] ..... G09F 3/00

(52) U.S. Cl. ..... 40/300; 40/675; 428/354

(58) Field of Search ..... 40/300, 301, 615, 40/675; 428/195.1, 343, 354, 355 R; 283/94, 108, 109

(56) References Cited

U.S. PATENT DOCUMENTS

| | | | |
|---|---|---|---|
| 2,862,832 A | 12/1958 | Shepherd, Jr. | |
| 2,882,599 A | 4/1959 | Martin | |
| 2,990,311 A | 6/1961 | Shepherd, Jr. | |
| 3,043,732 A | 7/1962 | Shepherd, Jr. | |
| 3,108,850 A | 10/1963 | Brandt | |
| 3,207,822 A | 9/1965 | Makowski | |
| 3,231,419 A | 1/1966 | Korpman | |
| 3,239,478 A | 3/1966 | Harlan, Jr. | |
| 3,380,868 A | 4/1968 | Moser | |
| 3,484,976 A | 12/1969 | Shea | |
| 3,503,826 A | 3/1970 | Nasica | |
| 3,616,015 A | 10/1971 | Kingston | |
| 3,625,752 A | 12/1971 | Korpman | |
| 3,676,202 A | 7/1972 | Korpman | |
| 3,723,170 A | 3/1973 | Korpman | |
| 3,733,002 A | 5/1973 | Fujio | |
| 3,758,661 A | 9/1973 | Yamamoto | |
| 3,783,072 A | 1/1974 | Korpman | |
| 3,932,328 A | 1/1976 | Korpman | |
| 3,940,001 A | 2/1976 | Haefner et al. | |
| 3,959,908 A | 6/1976 | Lowe | |
| 4,028,292 A | 6/1977 | Korpman | |
| 4,081,309 A | 3/1978 | Jenkins | |
| 4,133,926 A * | 1/1979 | Vorrier et al. | 428/200 |

(List continued on next page.)

FOREIGN PATENT DOCUMENTS

| | | |
|---|---|---|
| CA | 2044079 | 3/1992 |
| CA | 2012357 | 11/1999 |
| GB | 2 201 681 A | 9/1988 |
| JP | 2-217223 | 8/1990 |
| WO | 93/04842 | 3/1993 |
| WO | 0020199 | 4/2000 |

*Primary Examiner*—Brian K. Green
(74) *Attorney, Agent, or Firm*—Renner, Otto, Boisselle & Sklar, LLP

(57) ABSTRACT

Livestock identification tag assembly comprising: (a) a heat seal laminate comprising: (i) a facestock having an upper surface and a lower surface; (ii) a heat-activatable adhesive layer having an upper surface and a lower surface, wherein the upper surface of the heat-activatable adhesion layer is adhered to the lower surface of said facestock; (iii) an ink or graphics layer adhered to the lower surface of said heat-activatable layer; and (b) a flexible polymeric substrate; wherein the lower surface of the heat-activatable adhesive of the laminate is adhered to the substrate. In one embodiment, the ink or graphics layer is positioned between said heat-activatable adhesive layer and said facestock.

16 Claims, 6 Drawing Sheets

U.S. PATENT DOCUMENTS 4,137,081 A 1/1979 Pohl
4,174,218 A 11/1979 Pohl
4,175,460 A 11/1979 McPhail
4,228,232 A 10/1980 Rousseau
4,271,531 A 6/1981 Torii et al.
4,355,967 A 10/1982 Hellmer
4,359,314 A 11/1982 Hellmer
4,377,616 A 3/1983 Ashcraft et al.
D269,154 S 5/1983 Freedman et al.
4,393,115 A 7/1983 Yoshii et al.
4,398,985 A 8/1983 Eagon
4,406,411 A 9/1983 Gall et al.
4,426,422 A 1/1984 Daniels
4,456,934 A 6/1984 Wedman et al.
4,479,770 A 10/1984 Slat et al.
4,479,771 A 10/1984 Slat et al.
4,501,797 A 2/1985 Super et al.
4,501,798 A 2/1985 Koschak et al.
4,528,055 A 7/1985 Hattemer
4,528,221 A 7/1985 Komatsuzaki et al.
4,544,590 A 10/1985 Egan
4,557,963 A * 12/1985 Caines ..... 428/156
4,567,681 A 2/1986 Fumei
4,582,752 A 4/1986 Duncan
4,590,020 A 5/1986 Itaba et al.
4,599,253 A 7/1986 Bree
4,601,926 A 7/1986 Jabarin et al.
4,616,992 A 10/1986 Oles
4,626,455 A 12/1986 Karabedian
4,639,207 A 1/1987 Slat et al.
4,704,310 A 11/1987 Tighe et al.
4,704,323 A 11/1987 Duncan et al.
4,705,714 A 11/1987 Itaba et al.
4,710,338 A 12/1987 Bagnall et al.
4,713,273 A 12/1987 Freedman
4,720,416 A 1/1988 Duncan
4,721,531 A 1/1988 Wildeman et al.
4,721,638 A 1/1988 Matsuguchi et al.
4,729,864 A 3/1988 Chang et al.
4,737,098 A 4/1988 Oles et al.
4,746,556 A 5/1988 Matsuguchi et al.
4,758,396 A 7/1988 Crass et al.
4,762,737 A 8/1988 Lu
4,794,284 A 12/1988 Buon
4,808,366 A 2/1989 Kaminski et al.
4,824,912 A 4/1989 Su
4,834,641 A 5/1989 Keyser
4,837,075 A 6/1989 Dudley
4,837,088 A 6/1989 Freedman
4,855,187 A 8/1989 Osgood, Jr. et al.
4,863,772 A 9/1989 Cross
4,870,122 A 9/1989 Lu
4,872,707 A 10/1989 deBruin
4,873,088 A 10/1989 Mayhew et al.
4,883,697 A 11/1989 Dornbusch et al.
4,886,698 A 12/1989 Purdy
4,892,689 A 1/1990 Van Cappellen et al.
4,892,779 A 1/1990 Leatherman et al.
4,904,324 A 2/1990 Heider
4,916,025 A 4/1990 Lu
4,917,592 A 4/1990 Plenzler et al.
4,925,714 A 5/1990 Freedman
4,935,300 A 6/1990 Parker et al.
4,946,532 A 8/1990 Freeman
4,953,313 A 9/1990 Scott
4,983,348 A 1/1991 Barresi et al.
4,986,866 A 1/1991 Ohba et al.
5,019,436 A 5/1991 Schramer et al.
5,026,266 A 6/1991 Takasaki et al.
5,026,592 A 6/1991 Janocha et al.
5,032,344 A 7/1991 Kaminski
5,042,842 A 8/1991 Green et al.
5,073,435 A 12/1991 Eyraud et al.
5,075,583 A 12/1991 Sakagami et al.
5,076,977 A 12/1991 Maier et al.
5,079,057 A 1/1992 Heider
5,104,719 A 4/1992 Kamen et al.
5,126,197 A 6/1992 Schinkel et al.
5,152,946 A 10/1992 Gillette
5,186,782 A 2/1993 Freedman
5,223,315 A 6/1993 Katsura et al.
5,223,346 A 6/1993 Lu
5,242,650 A 9/1993 Rackovan et al.
5,284,681 A 2/1994 Shinonaga et al.
5,284,688 A 2/1994 Hiatt
5,288,548 A 2/1994 Weber
5,308,693 A 5/1994 Ryle et al.
5,332,542 A 7/1994 Yamanaka et al.
5,366,796 A 11/1994 Murschall et al.
5,405,667 A 4/1995 Heider
5,424,650 A 6/1995 Frick
5,435,963 A 7/1995 Rackovan et al.
5,475,075 A 12/1995 Brant et al.
5,495,944 A 3/1996 Lermer
5,562,962 A 10/1996 Tung
5,587,214 A 12/1996 Mitchell, Jr.
5,595,810 A * 1/1997 Beinert et al. ..... 428/156
5,604,006 A 2/1997 Ponchaud et al.
5,614,146 A 3/1997 Nakamura et al.
5,711,839 A 1/1998 Dronzek, Jr.
5,725,261 A 3/1998 Rahn
5,725,962 A 3/1998 Bader et al.
5,733,615 A 3/1998 Rackovan et al.
5,876,816 A 3/1999 Freedman
6,001,208 A 12/1999 Kinoshita et al.
6,004,682 A 12/1999 Rackovan et al.
6,146,744 A 11/2000 Freedman
6,150,013 A 11/2000 Balaji et al.
6,228,486 B1 5/2001 Kittel et al.
6,294,236 B1 9/2001 Freedman
6,461,722 B1 * 10/2002 Kittel et al. ..... 428/195
2001/0028952 A1 10/2001 Nishizawa et al.
2002/0050319 A1 5/2002 Nishizawa et al.
2002/0127361 A1 9/2002 Sandt et al. ..... 428/40.1

* cited by examiner

LIVESTOCK SECURITY TAG ASSEMBLY

TECHNICAL FIELD

This invention relates to identification tag assemblies, and more specifically, to tamper resistant, durable identification tag assemblies that can be variably imprinted with data. The identification tags may include human readable data and machine readable data, as well as a radio frequency identification device within the tag assembly.

BACKGROUND OF THE INVENTION

The use of identification tags for attaching to livestock is well known. Typically, the identification tag, which is printed with an identifying number, is attached to the animal's ear. Many problems occur with such printed identification tags. The print on the identification tags fade and may become unreadable due to exposure to the elements and to animal waste. In addition, the surface of the tags may become scratched or damaged due to contact between the animals or between the animal and fences or other structures. Tampering with the identifying print is another problem encountered with printed identification tags.

U.S. Pat. No. 5,725,261 discloses an identification tag that includes a pre-printed plastic substrate laminated between two thermoplastic films. Human and/or machine readable information is printed onto the plastic substrate.

SUMMARY OF THE INVENTION

This invention relates to a heat seal laminate, comprising (i) a facestock having an upper surface and a lower surface; (ii) a heat-activatable adhesive layer adhered to the lower surface of the facestock; (iii) a laminating adhesive overlying the upper surface of the facestock; and a carrier layer adhered to the laminating adhesive layer.

The invention further relates to a livestock identification tag assembly and the process for making the identification tag assembly. The identification tag assembly comprises (a) a heat seal laminate comprising: (i) a facestock having an upper surface and a lower surface; (ii) a heat-activatable adhesive layer having an upper and a lower surface, wherein the upper surface of the heat-activatable layer is adhered to the lower surface of the facestock; (iii) an ink or graphics layer adhered to the lower surface of the heat-activatable adhesive layer; and (b) a flexible polymeric substrate; wherein the lower surface of the heat-activatable adhesive of the laminate is adhered to the substrate.

In one embodiment, the livestock identification tag assembly further comprises a carrier layer overlying the upper surface of the facestock.

In one embodiment, the livestock identification tag assembly further comprises a detack layer adhered to the lower surface of the heat activatable adhesive layer.

In one embodiment, the livestock identification tag assembly further comprises a tie layer between the heat activatable layer and the facestock.

In one embodiment, the facestock layer of the livestock identification tag assembly comprises a multi-layered construction.

BRIEF DESCRIPTION OF THE DRAWINGS

In the annexed drawings, like references indicate like parts or features.

DESCRIPTION OF THE PREFERRED EMBODIMENTS

The term "overlies" and cognate terms such as "overlying" and the like, when referring to the relationship of one or a first layer relative to another or a second layer, refers to the fact that the first layer partially or completely lies over the second layer. The first layer overlying the second layer may or may not be in contact with the second layer. For example, one or more additional layers may be positioned between the first layer and the second layer. The term "underlies" and cognate terms such as "underlying" and the like have similar meanings except that the first layer partially or completely lies under, rather than over, the second layer.

The term "transparent" when referring to one or more layers overlying the ink or graphics layer of the inventive livestock identification tag assembly means that the ink or graphics layer can be seen through such layer or layers.

Figure 1:
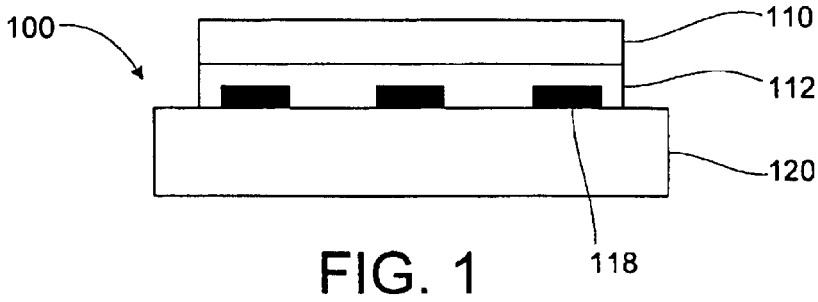
FIG. 1 is a schematic illustration of the side view of a livestock identification tag assembly embodying the present invention in a particular form.

Referring to FIG. 1, the inventive livestock identification tag assembly, in one of its illustrated embodiments, is generally indicated by the reference numeral 100, and is comprised of: a facestock 110, a heat-activatable adhesive layer 112 adhered to facestock 110, ink or identifying indicia 118 within the lower portion of heat-activatable adhesive layer 112, and substrate 120 adhered to heat-activatable adhesive layer 112.

Substrate 120, in one embodiment of the present invention is in the form of an ear tag for animals. To ensure that the tag does not become snagged by fences, bushes or other substantially fixed objects, the tag is made of a flexible resilient plastic material. Thus if snagging does occur, the tag can flex and become disengaged from the snagging object. A useful material for the tag is flexible molded polyurethane. The polyurethane may be impregnated with an insecticide, that over time releases onto the animal's ear and migrates over the animal's body. Other useful materials for the substrate include flexible, durable polymers such as polyvinyl chloride.

The substrate may be preprinted with identifying indicia by any suitable process, including laser etching, hot stamping, ink jet printing, flexographic printing, flat bed screen printing, rotary screen printing, rotary letterpress gravure and off-set gravure printing. In another embodiment, the identifying indicia is incorporated into the heat seal laminate that is applied to the substrate.

Figure 2:
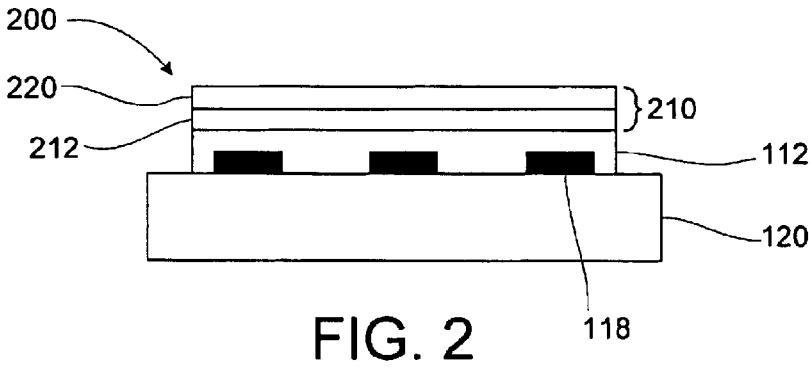
FIG. 2 is a schematic illustration of the side view of an alternative embodiment of a livestock identification tag assembly of the present invention, in which the facestock is a multilayer film.

Facestock layer 110 is a clear flexible layer and may be comprised of a transparent thermoplastic film having a single layer or multiple layers. FIG. 2 illustrates an embodiment of the present invention in which the facestock comprises multiple layers. The inventive tag assembly is indicated by the reference numeral 200, and is comprised of facestock 210, a heat-activatable adhesive layer 112 adhered to facestock 200, ink or identifying indicia 118 within the lower portion of heat-activatable adhesive layer 112, and substrate 120 adhered to heat-activatable adhesive layer 112. Facestock 210 comprises a first thermoplastic film 220 and a second thermoplastic film 212. The thermoplastic film may be comprised of, for example, polyolefins (linear or branched), polyamides, polystyrenes, nylon, polyesters, polyester copolymers, polyurethanes, polysulfones, styrene-maleic anhydride copolymers, styrene-acrylonitrile copolymers, ionomers based on sodium or zinc salts of ethylene methacrylic acid, polymethyl methacrylates, cellulosics, acrylic polymers and copolymers, polycarbonates, polyacrylonitriles, and ethylene-vinyl acetate copolymers. Included in this group are the acrylates such as ethylene methacrylic acid, ethylene methyl acrylate, ethylene acrylic acid and ethylene ethyl acrylate. Also, included in this group are polymers and copolymers of olefin monomers having, for example, 2 to about 12 carbon atoms, and in one embodiment 2 to about 8 carbon atoms. These include the polymers of α-olefins having from 2 to about 4 carbon atoms per molecule. These include polyethylene, polypropylene, poly-1-butene, and the like. An example of a copolymer within the above definition is a copolymer of ethylene with 1-butene having from about 1 to about 10 weight percent of the 1-butene comonomer incorporated into the copolymer molecule. The polyethylenes that are useful have various densities including low, medium and high density ranges. The low density range is from about 0.910 to about 0.925 g/cm$^3$; the medium density range is from about 0.925 to about 0.940 g/cm$^3$; and the high density range is from about 0.940 to about 0.965 g/cm$^3$. An example of a commercially available material that is useful is available from DuPont under the trade designation Mylar LB; this material is identified as being a biaxially oriented polyester film. Films prepared from blends of copolymers or blends of copolymers with homopolymers also are useful. The films may be extruded as monolayered films or multi-layered films. The films may be oriented films or nonoriented films.

In one embodiment, the facestock comprises a polyvinyl chloride film. In another embodiment, the facestock comprises a polyethylene terephthalate film.

In one embodiment, the facestock comprises a transparent thermoplastic film made of polyurethane. Polyester- and polyether-type polyurethanes may be used as the facestock film. Examples of such polyurethanes include Estane 58277 commercially available from BF Goodrich and Morthane L425.77D commercially available from Morton International. In general, the film is prepared by melting the polyurethane resin with the desired additives, extruding the polyurethane and forming on a blown film line. The film is then oriented.

In one embodiment, the facestock comprises a coextruded multi-layered film. Each layer may be made of polyethylene, polypropylene, ethylene vinyl acetate, ethyl methacrylate, polyethylene terephthalate, ionomer resins derived from sodium, lithium, or zinc and copolymers of ethylene and methacrylic acid commercially available under the tradename, Surlyn™, or blends thereof. The thickness of the facestock is within the range of about 0.20 mil to about 20 mils. In one embodiment, the thickness of the facestock is within the range of about 1 mil to about 5 mils.

The heat-activatable adhesive layer may be made from heat-activatable adhesives or thermoplastic film materials. These include polyolefins (linear or branched); polyamides such as nylon; polyester copolymers; polyurethanes thermoplastic adhesives including polyurethane polyesters and polyurethane polyethers; ionomers based on sodium or zinc salts of ethylene methacrylic acid; polyacrylonitriles; and ethylene-vinyl acetate copolymers. Another useful heat-activatable adhesive is an unsaturated polyester having a heat-activated curing agent such as a blocked isocyanate. Included in the group of ethylene-vinyl acetate copolymers are the acrylates such as ethylene methacrylic acid, ethylene methyl acrylate, ethylene acrylic acid and ethylene ethyl acrylate. Also, included in the group of useful adhesives are polymers and copolymers of olefin monomers having, for example, 2 to about 12 carbon atoms, and in one embodiment 2 to about 8 carbon atoms. These include the polymers of α-olefins having from 2 to about 4 carbon atoms per molecule. These include polyethylene, polypropylene, poly-1-butene, and the like. An example of a copolymer within the above definition is a copolymer of ethylene with 1-butene having from about 1 to about 10 weight percent of the 1-butene comonomer incorporated into the copolymer molecule. The polyolefins include amorphous polyolefins. The polyethylenes that are useful have various densities including low, medium and high density ranges as defined above. The ethylene/methyl acrylate copolymers available from Chevron under the tradename EMAC can be used. These include EMAC 2260, which has a methyl acrylate content of 24% by weight and a melt index of 2.0 grams/10 minutes at 190° C., 2.16 Kg; and EMAC SP 2268T, which also has a methyl acrylate content of 24% by weight and a melt index of 10 grams/10 minutes at 190° C., 2.16 Kg. Polymer film materials prepared from blends of copolymers or blends of copolymers with homopolymers are also useful. The heat-activatable layer may contain ultraviolet (UV) light absorbers or other light stabilizers. These additives are included to prevent degradation due to sunlight. One useful type of stabilizer is a hindered amine light stabilizer.

In one embodiment of the present invention, the heat-activatable adhesive layer comprises a polyurethane adhesive that is the reaction product of an organic polyisocyanate such as hexamethylene diisocyanate, toluene diisocyanate, diphenyl diisocyanate, tetramethylene diisocyanate, toluene triisocyanate, trophenylmethyl triisocyanate, polyaryl polyisocyanate and the like, with an active hydrogen-containing compound such as those containing hydroxyl and/or amino groups exemplified by glycols, polyols, hydroxylated polyesters, diamines and the like. The polyurethane adhesive may contain an adhesion promoting agent selected from the N-substituted -2-pyrrolidone and ethoxylated alkyl phenol. In another embodiment of the present invention, the heat-activatable adhesive layer is a linear saturated polyester polymer that includes a heat activating curing agent. The uncured polyester itself is a linear alkyl saturated polyester formed by reacting a glycol with a diacid. The molecular weight of the uncured polyester polymer must be low enough to flow and wet the surface of the substrate at application temperature, i.e., generally about less than 400° F. In one embodiment, the molecular weight is in the range of about 5,000 to about 30,000, and in another embodiment, the molecular weight is in the range of about 10,000 to about 15,000. The polyester adhesive includes a heat activated curing agent, such as a heat activated polyisocyanate curing agent. Suitable diols include ethylene glycol, propylene glycol, 1,3-propane diol, 1,4-butane diol, 1,5-pentane diol, 1,6-hexane diol, 1,8-octane diol, 1,4-cyclohexanedimethanol, 1,3-cyclohexanedimethanol, diethylene glycol and the like. Useful diacids for making these polymers include aromatic dicarboxylic acids having no vinyl saturation such as isophthalic acid or anhydride, phthalic acid or anhydride, terephthalic acid or aliphatic dicarboxylic acids such as adipic acid, succinic acid, gluteric acid and the like.

The heat activated curing agent acts to cure the polyester upon heating. The heat activated curing agent can be an isocyanate curing agent, preferably a blocked isocyanate curing agent. Suitable curing agents include phenol blocked methylene bis-4-phenylisocyanate such as those disclosed in U.S. Pat. No. 3,307,966 and phenolaldehyde blocked polyisocyanates such as those discussed in U.S. Pat. No. 3,226,276. Other blocked isocyanates include dimerized toluene diisocyanates and methylethyl-ketoxime blocked isocyanates. A useful adhesive is Bostik adhesive 10-300-3, which is a thermosetting linear saturated polyester adhesive using an isocyanate curing agent and a polyester formed form ethylene glycol and methylterphthalic acid. The blocked isocyanate/uncured linear polyester is dissolved in methylethyl ketone and methylene chloride and has a weight average molecular weight of 10,000 to 15,000.

In one embodiment, the heat seal laminate comprises a tie layer between the facestock layer and the heat activatable adhesive layer. The tie layer improves the adhesion between the heat activatable adhesion layer and the facestock layer. In one embodiment, the tie layer comprises an epoxide resin layer, the facestock comprises a polypropylene resin layer, and the heat activatable layer comprises a polyurethane resin layer.

Figure 10:
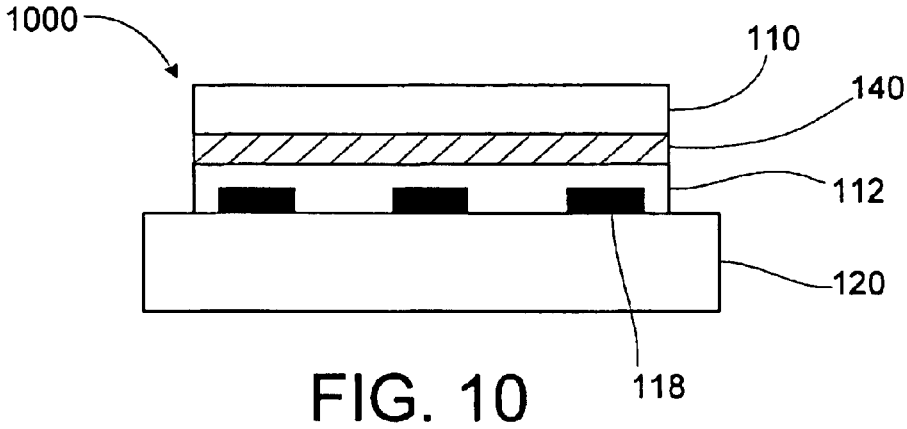
FIG. 10 is a schematic illustration of the side view of a livestock identification tag assembly embodying the present invention in a particular form, including a tie layer.

FIG. 10 is a schematic illustration of the side view of a livestock identification tag assembly 1000 similar to the tag assembly shown in FIG. 1, but further including a tie layer 140 between the heat-activatable adhesive layer 112 and the first facestock 110.

The facestock layer, tie layer and heat-activatable adhesive layer may be made using a polymeric coextrusion process. The coextrudate of polymeric film materials may be formed by simultaneous extrusion from two or more extruders and a suitable known type of coextrusion die whereby the facestock layer, tie layer and heat-activatable are adhered to each other in a permanently combined state to provide a unitary coextrudate. Alternatively, a coating process may be used to lay down one or more of the layers onto a moving web. The processes for making the facestock and heat-activatable layers are well known in the art.

The facestock layer(s), heat-activatable adhesive layer, and tie layer, if present, may contain ultraviolet (UV) light absorbers or other light stabilizers. These additives are included to prevent degradation due to sunlight. One useful type of stabilizer is a hindered amine light stabilizer. Hindered amine light stabilizers are described in the literature such as in U.S. Pat. No. 4,721,531, columns 4 to 9, which are incorporated herein by reference. The hindered amine light stabilizers may, for example, be derivatives of 2,2,6,6-tetraalkyl piperidines or substituted piperizinediones. A number of hindered amine light stabilizers useful in the invention are available commercially such as from Ciba-Geigy Corporation under the general trade designations "Tinuvin" and "Chemassorb", and from Cytec under the general designation "Cyasorb-UV". Examples include Tinuvin 111 which is identified as a mixture of 1,3,5-Triazine-2,4,6-triamine, N,N'-[1,2-ethanediylbis[[[4,6-bis[butyl(1,2,2,6,6-pentamethyl-4-piperidinyl)amino]-1,3,5-triazin-2-yl]imino]-3,1propanediyl]]-bis[N,N'-dibutyl-N,N'-bis (1,2,2,6,6-pentamethyl-4-piperidinyl)-and dimethyl succinate polymer with 4-hydroxy-2,2,6,6,-tetramethyl-1-piperidineethanol; Tinuvin 123 which is identified as bis-(1-octyloxy-2,2,6,6-tetramethyl-4-piperidinyl) sebacate; Tinuvin 770 which is identified as bis-(2,2,6,6-tetramethyl-4-piperidinyl)-sebacate; Tinuvin 765 which is identified as bis-(1,2,2,6,6-pentamethyl-4-piperidinyl)-sebacate; Tinuvin 622 which is a dimethyl succinate polymer with 4-hydroxy-2,2,6,6,-tetramethyl-1-piperidineethanol; and Chemassorb 944 which is poly[[6-(1,1,3,3-tetramethylbutyl) amino]-1,3,5-triazine-2,4-diyl][[2,2,6,6-tetramethyl-4-piperidyl) imino]]hexamethylene (2,2,6,6-tetramethyl-4-piperidyl) imino]], and Chemassorb 119 which is identified as being 1,3,5-Triazine-2,4,6-triamine-N,N'-[1,2-ethanediylbis[[[4.6-bis[butyl(1,2,2,6,6-pentamethyl-4-peperidinyl)amino]-1,3,5-triazin-2-yl]imino]-3,1 propanediyl]]-bis[N,N'-dibutyl-N,N'-bis (1,2,2,6,6-pentamethyl-4-piperidinyl). UV light absorbers include those available from Ciba-Geigy under the Tinuvin name and Great Lakes Chemical Corporation under the trade designation "Lowilite". Examples include: Tinuvin P, which is identified as 2-(2'-hydroxy-5'-methylphenyl)-benzotriazole; Tinuvin 326, which is identified as 2-(3'-tert-butyl-2'-hydroxy-5'methylphenyl)-5-chlorobenzotriazole; Tinuvin 238, which is identified as 2-(2'hydroxy-3',5'-di-tert-amylphenyl) benzotriazole; Lowilite 20, which is identified as 2-hydroxy-4-methoxy-benzophenone; Lowilite 22, which is identified as 2-hydroxy-4-n-octoxy-benzophenone; and Lowilite 1200, which is identified as 2-hydroxy-4-n-dodecyloxy-benzophenone. A useful stabilizer is available under the tradename Ampacet 10561 which is a product of Ampacet identified as a UV stabilizer concentrate containing 20% by weight of a UV stabilizer and 80% by weight of a low density polyethylene carrier resin. The concentration of UV absorber or light stabilizer may be up to about 2.5% by weight, and in one embodiment may be about 0.05% to about 1% by weight.

Figure 3:
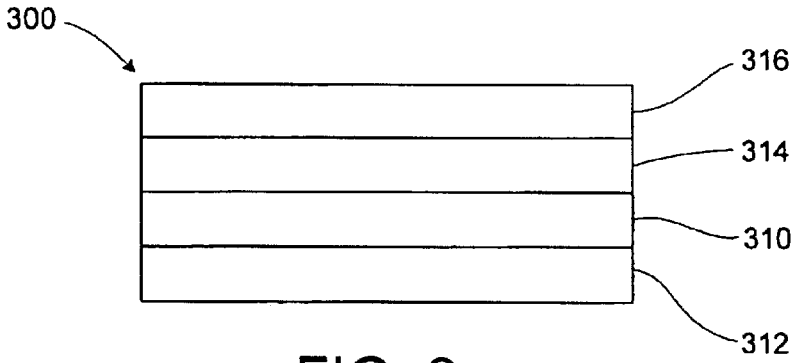
FIG. 3 is a schematic illustration of the side view of the heat seal laminate of the present invention.

Referring to FIG. 3, the inventive heat seal laminate, in one of its illustrated embodiments, in generally indicated by the reference numeral 300, and is comprised of a facestock 310, a heat-activatable adhesive layer 312 underlying the facestock 310, laminating adhesive layer 314 overlaying facestock 310, and a carrier sheet 316 adhered to the adhesive layer 314.

The laminating adhesive layer may be comprised of any removable pressure-sensitive adhesive material, or radiation-curable, especially UV curable, adhesive material suitable for coating a film substrate. In one embodiment, the laminating adhesive is transparent. The radiation-curable adhesive materials may be made from compositions containing multifunctional acrylate monomers and oligomers. Acrylated urethanes and acrylated acrylics are useful. The radiation-curable adhesives may include photoinitiators and optionally surfactants to provide a uniform flow resulting in an even coating. An example of a commercially available adhesive material that can be used is Rad-Cure UV 1008 (a product of Rad-Cure Corporation identified as a UV-curable, solvent-free adhesive containing 70–95% by weight multi-functional acrylate monomers and oligomers, 5–20% by weight photoinitiator and 0–5% by weight surfactants).

The removable pressure-sensitive adhesive can be any removable pressure-sensitive adhesive known in the art for use with film substrates. The term "removable" is used herein to refer to an adhesive that can stick to the facestock layer and carrier layer without edge lifting and can be removed without damaging either the facestock or the carrier layer. The removable adhesive layer is preferentially adherent to the carrier layer and thus separates from the facestock with the carrier layer. The removable pressure-sensitive adhesives that can be used are known in the art and include rubber based adhesives, acrylic adhesives, vinyl ether adhesives, silicone adhesives, and mixtures of two or more thereof. The adhesives may be hot melt, solvent-based or water based adhesives. Included are the pressure-sensitive adhesive materials described in "Adhesion and Bond", *Encyclopedia of Polymer Science and Engineering*, Vol. 1, pages 476–546, Interscience Publishers, $2^{nd}$ Ed. 1985, the disclosure of which is hereby incorporated by reference. The pressure sensitive adhesive materials that are useful may contain as a major constituent and adhesive polymer such as acrylic-type polymers; block copolymers; natural, reclaimed, or styrene-butadiene rubbers; tackified natural or synthetic rubbers; or random copolymers of ethylene and vinyl acetate, ethylene-vinyl-acrylic terpolymers, polyisobutylene, poly(vinyl ether), etc. Other materials may be included in the pressure sensitive adhesive such as tackifying resins, plasticizers, antioxidants, fillers, pigments, waxes, etc. The adhesive layer has a thickness that is typically in the range of about 0.5 to about 5 microns, and in one embodiment about 1 to about 4 microns, and in one embodiment about 1.5 to about microns.

The carrier layer is placed in contact with the removable or radiation-curable laminating adhesive layer using known techniques. When the adhesive layer is a radiation-curable adhesive, the carrier sheet is placed in contact with the adhesive prior to the curing of adhesive layer. The adhesive layer is then cured. When the adhesive is a pressure-sensitive adhesive, it may be initially applied to the carrier layer, and then the carrier layer with applied adhesive is adhered to the facestock. Alternatively, the pressure-sensitive adhesive may be applied to the facestock, and then the carrier layer is placed in contact with the adhesive to adhere the carrier sheet to the facestock. The carrier layer can be comprised of paper, polymer film, or a combination thereof. In one embodiment, the carrier layer is transparent to permit visibility of the ink or graphics layer through the carrier layer (as well as through the other layers between the carrier layer and the ink or graphics layer). The outer surface of the carrier layer may have a release coating adhered to it to facilitate rolling and unrolling of the thermal transfer laminates. Any release coating known in the art can be used. Silicone release coatings are especially useful. A commercially available polyester film that is useful as the carrier layer is E19506, a product of Douglas Hanson identified as a clear polyester film having a release coating layer adhered to one side. Untreated polyester film can also be used. For example, a polyethylene terephthalate film or a biaxially oriented polypropylene film may be used as the carrier layer. The carrier layer typically has a thickness of about 0.25 to about 10 mils, and in one embodiment, about 0.5 to about 5 mils, and in one embodiment about 2 mils. In one embodiment, the carrier layer is a polyester film having a thickness of about 0.25 to about 10 mils. In one embodiment, the carrier layer is a polyolefin film having a thickness of about 0.5 to about 5 mils. In one embodiment, the carrier layer is a paper sheet having a thickness of about 1 to about 10 mils.

In one embodiment of the present invention, the identification indicia is imprinted onto the surface of heat-activatable adhesive layer prior to laminating the heat seal laminate to the substrate. Variable data such as serial numbers, bar codes, ID matrix, glyph codes, and the like may be imprinted onto the heat activatable adhesive by conventional printing techniques such as thermal transfer, hot stamp, pad printing, ink jet, dot matrix, laser etch, laser toner, and hand printing. In another embodiment, the ink or graphic layer is printed on the facestock layer. The ink or graphics may be positioned between the facestock and heat-activatable layer. In another embodiment, the identifying indicia can be applied to the flexible substrate by suitable processes including laser etching, hot stamping and ink jet printing. The ink or identification indicia on the flexible substrate may be mono-colored or multi-colored ink layer. The thickness of the ink layer is typically in the range of about 0.5 to about 5 microns, and in one embodiment about 1 to about 4 microns, and in one embodiment about 3 microns. The inks used in the ink layer are preferably commercially available water-based, solvent-based or radiation curable, especially UV curable inks, appropriately chosen for the particular construction of the identification tag assembly and/or the printing method used. Examples include Sun Sheen (a product of Sun Chemical identified as an alcohol dilutable polyamide ink), Suntex MP (a product of Sun Chemical identified as a solvent-based ink formulated for surface printing acrylic coated substrates and polyolefin films), X-Cel (a product of Water Ink Technologies identified as a water-based film ink for printing film substrates), Uvilith AR-109 Rubine Red (a product of Daw Ink identified as a UV ink) and CLA91598F (a product of Sun Chemical Identified as a multibond black solvent-based ink).

Figure 4:
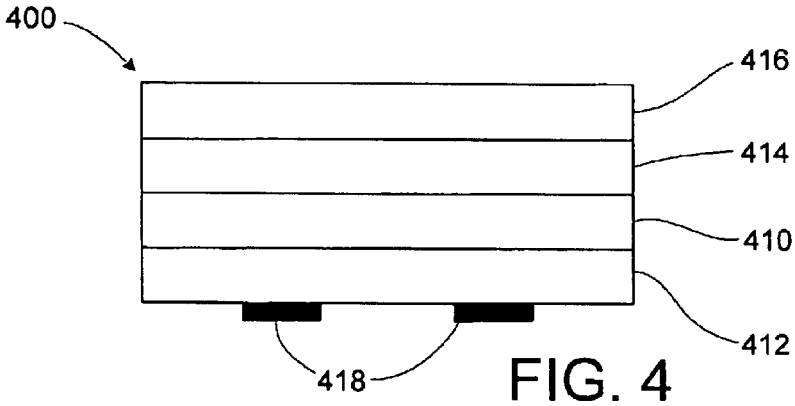
FIG. 4 is a schematic illustration of the side view of an alternative embodiment of the heat seal laminate of the present invention, wherein a layer of ink or graphics is positioned on the outer surface of the heat-activatable adhesive layer.

Referring to FIG. 4, the inventive heat seal laminate, in one of its illustrated embodiments, is generally indicated by the reference numeral 400, and is comprised of a facestock 410, a heat-activatable adhesive layer 412 underlying the facestock 410, laminating adhesive layer 414 overlaying facestock 410, and a carrier sheet 416 adhered to the adhesive layer 314. An ink or graphics layer 418 is positioned on the outer surface of heat-activatable layer 412.

In one embodiment, a radio frequency identification device (RFID) is attached to the substrate or to the heat-activatable adhesive layer, so that upon lamination of the heat seal laminate to the substrate, the RFID is bonded to the identification tag. The heat seal laminate is prepared by applying a laminating adhesive layer to the upper surface of a facestock film. The facestock film has a layer of heat-activatable adhesive adhered to its lower surface. The facestock film and heat-activatable adhesive may be coextruded, laminated together using heat and pressure, or the adhesive layer may be coated directly onto the facestock film. After applying the laminating adhesive, a carrier sheet is adhered to the laminating adhesive. If the laminating adhesive is a UV curable adhesive, the laminating adhesive layer is then UV cured to complete the fabrication of the desired heat seal laminate.

Figure 5:
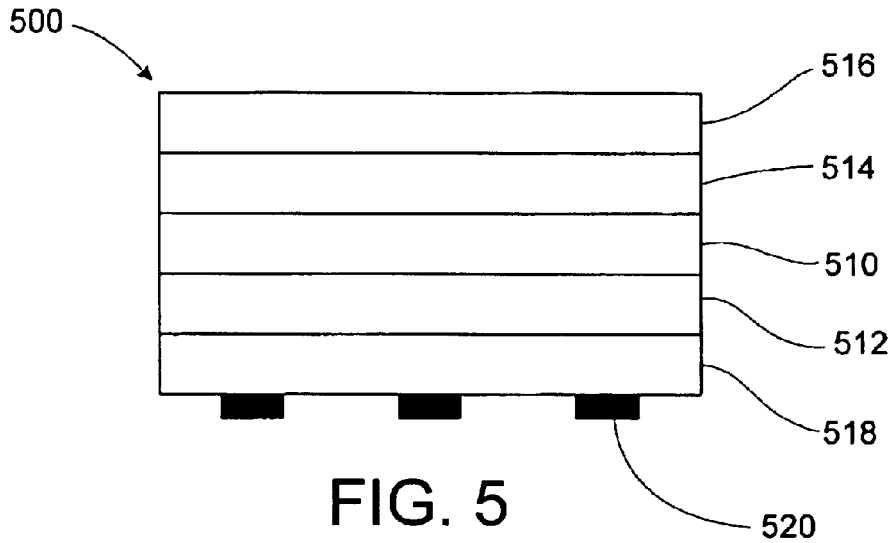
FIG. 5 is a schematic illustration of the side view of an alternative embodiment of the heat seal laminate of the present invention, wherein a detack layer is positioned on the lower surface of the heat-activatable adhesive layer.

In one embodiment, a detack layer is applied to the heat activatable adhesive. This embodiment is shown in FIG. 5.

Figure 6:
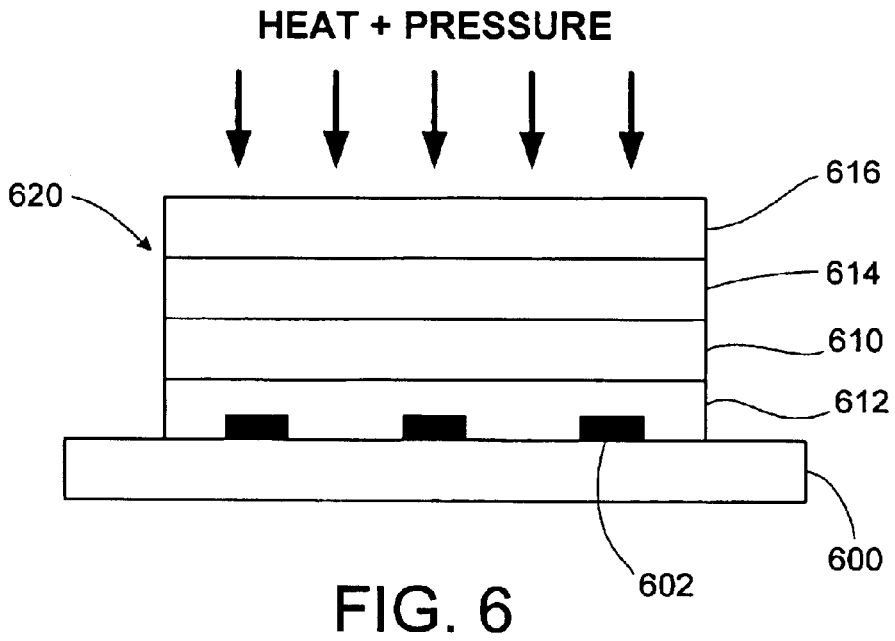
FIG. 6 is a schematic illustration showing the heat seal laminate of FIG. 4 being adhered to a livestock identification tag.

The heat seal laminate is indicated by reference numeral 500, and is comprised of a facestock 510, a heat activatable adhesive layer 512 underlying the facestock 510, laminating adhesive layer 514 adhered to facestock 510, carrier sheet 516 adhered to the laminating adhesive, and detack layer 518 applied to heat activatable adhesive layer 512. The detack layer prevents the heat activatable adhesive from becoming prematurely tacky during printing operations. Ink members 520 are printed directly onto detack layer 518. Alternatively, the ink members may be printed directly onto the heat activatable adhesive 512, and then over coated with detack layer 518. The detack layer may be compatible with the adhesive 512, so that upon exposure to heat, the detack layer is absorbed into the adhesive layer. The adhesive would then become tacky again. An example of such a detack layer is a high softening point tackifier such as terpene phenolic. Other useful detack layer materials include polyamides and fatty acids. The heat seal laminate may be adhered to the livestock tag using heat-sealing techniques known in the art. Referring to FIG. 6, the heat seal laminate 620 is placed on substrate 600 with the heat-activatable adhesive layer 612 in contact with the substrate, and ink layer 602 printed on substrate 600 or printed on adhesive layer 612. Heat and pressure are applied to the heat seal laminate by a heated platen in contact with the carrier sheet 616. The heat passes through the heat seal laminate 620 and softens or melts the heat-activatable layer 612. The heat and pressure are removed, and the heat-activatable adhesive layer 612 cools and solidifies resulting in the formation of a heat-sealed bond between the heat seal laminate 620 and the substrate 600. Temperatures in the range of about 100° C. to about 300° C., and in one embodiment about 150° C. to about 250° C., and in one embodiment about 180° C. to about 210° C., are typically used. Pressures in the range of about 2 to about 20 psi, and in one embodiment about 8 to about 12 psi, are typically used. Dwell times of about 0.5 to about 60 seconds, and in one embodiment about 0.5 to 20 seconds, and in one embodiment about 0.5 to about 10 seconds may be used. Any heat-sealing press used for heat-sealing labels, tapes, decals and the like, to substrates can be used. These are well known in the art. Upon application of the heat seal laminate to the substrate, the carrier sheet and laminating adhesive are removed using known removal or stripping techniques.

Figure 7A:
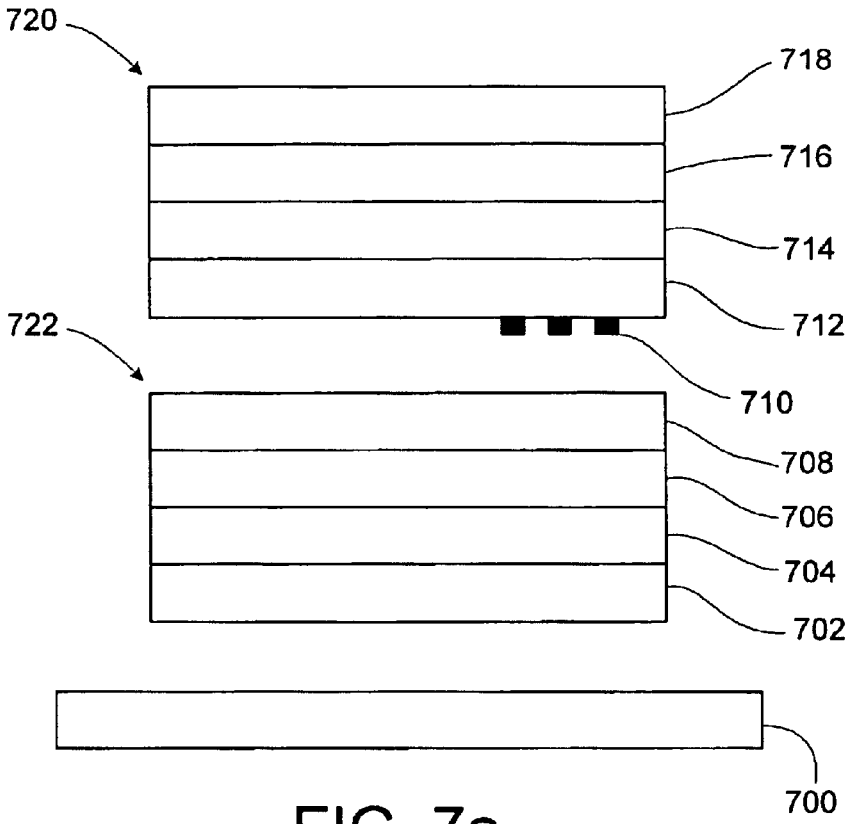
FIGS. 7*a*–7*c* are schematic illustrations of the side view of an alternative embodiment of a livestock identification tag assembly, wherein a pigmented film is incorporated within the laminate structure.
Figure 7B:
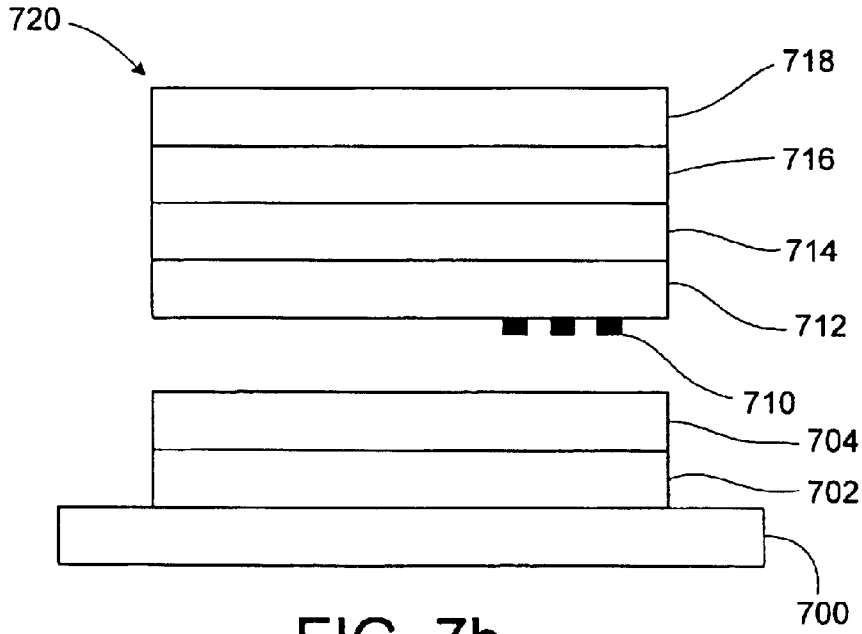
Figure 7C:
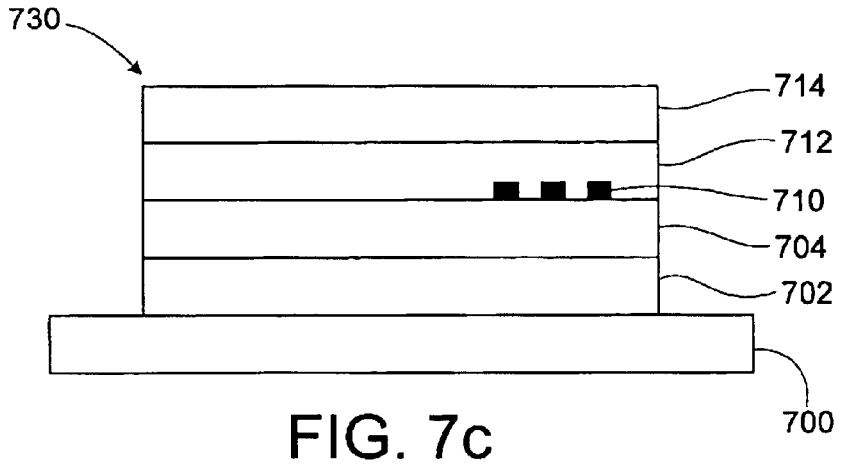

Another embodiment of the livestock identification tag assembly, and the method for making the tag assembly are illustrated in FIGS. 7*a* to 7*c*. In this embodiment, a two-component laminate is used to make the identification tag assembly. Referring to FIG. 7*a*, laminating component 720 comprises heat-activatable adhesive layer 712, transparent facestock 714 overlying heat-activatable adhesive layer 712, laminating adhesive layer 716 overlying facestock 714 and carrier layer 718 adhered to laminating adhesive layer 716. Heat-activatable layer 712 may have print indicia 710 on its lower surface. Inner laminating component 722 comprises pigmented facestock 704, heat-activatable adhesive layer 702 adhered to pigmented facestock 704 and carrier layer 708 adhered to printable facestock 704 by laminating adhesive 706.

The method of making identification tag assembly 730 involves applying inner laminating component 722 to substrate 700 by applying heat and pressure to carrier 708, and then removing carrier 708 and laminating adhesive 706 from the substrate. As shown in FIG. 7*b*, inner laminate 722 is bonded to substrate 700 and comprises heat-activatable adhesive 702 and pigmented facestock 704. As shown in FIG. 7*c*, laminating component 720 is then placed over substrate 700 and over inner laminate 722 and heat and pressure is applied to carrier layer 718. Heat-activatable layer 712 bonds to pigmented facestock 704. Carrier layer 718 and laminating adhesive 716 are then removed. Identifying indicia 710 may be printed onto heat activatable layer 702 prior to the application of component 720. The finished identification tag assembly, identified as 730 FIG. 7*c*.

The pigments that can be used in pigmented facestock 704 include titanium dioxide, both rutile and anatase crystal structure. In one embodiment, the pigment is added to the facestock material in the form of a concentrate containing pigment and a resin carrier. The concentrate may contain, for example, for example, about 20% to about 80% by weight pigment, and about 20% to about 80% by weight resin carrier. The resin carrier can be any thermoplastic polymer having a melting point in the range of about 100° C. to about 265° C. Examples include polyethylene, polypropylene, polybutylene, polyester, nylon and the like. In one embodiment, a titanium dioxide concentrate is used which is comprised of a blend of about 30% to about 70% by weight polypropylene and about 70% to about 30% by weight titanium dioxide. An example of a commercially available pigment concentrate that can be used is available from A. Schulman Inc. under the tradename PolyBatch White P8555 SD, which is identified as a white color concentrate having a coated rutile titanium dioxide concentration of 50% by weight in a polypropylene homopolymer carrier resin. Another example is Ampacet 110233 which is a product of Ampacet Corporation identified as a $TiO_2$ concentrate containing 50% rutile $TiO_2$ and 50% low density polyethylene. The concentration of pigment in the core layers 112 and 212 can be up to about 25% by weight, and when used is generally in the range of about 5% to about 25% by weight, and in one embodiment about 10% to about 20% by weight.

The pigmented facestock layer may include a filler material to increase opacity. The fillers that can be used include calcium carbonate and talc. In one embodiment, the filler is added to the core layer material in the form of a concentrate containing the filler and a resin carrier. The concentrate may contain, for example, about 20% to about 80% by weight filler, and about 20% to about 80% by weight resin carrier. The resin carrier can be any thermoplastic polymer having a melting point in the range of about 100° C. to about 265° C. Examples include polyethylene, polypropylene, polybutylene, polyester, nylon, and the like. Also included are thermoplastic copolymers such as ethylene methylacrylate, and the like. In one embodiment, a calcium carbonate concentrate is used which is comprised of a blend of about 50% to about 80% by weight polypropylene and about 20% to about 50% by weight calcium carbonate. An example of a commercially available pigment concentrate that can be used is available from A. Schulman Inc. under the tradename PF 920, which is identified as a calcium carbonate concentrate having a calcium carbonate concentration of 40% by weight in a polypropylene homopolymer carrier resin. Another example is Ampacet 101087 which is a product of Ampacet Corporation identified as a calcium carbonate concentrate containing 30% by weight calcium carbonate and 70% by weight ethylene methylacrylate. The concentration of filler in the layers 212 and 312 may be up to about 40% by weight, and when used is generally in the range of about 10% to about 40% by weigh, and in one embodiment about 10% to about 35% by weight.

Figure 8A:
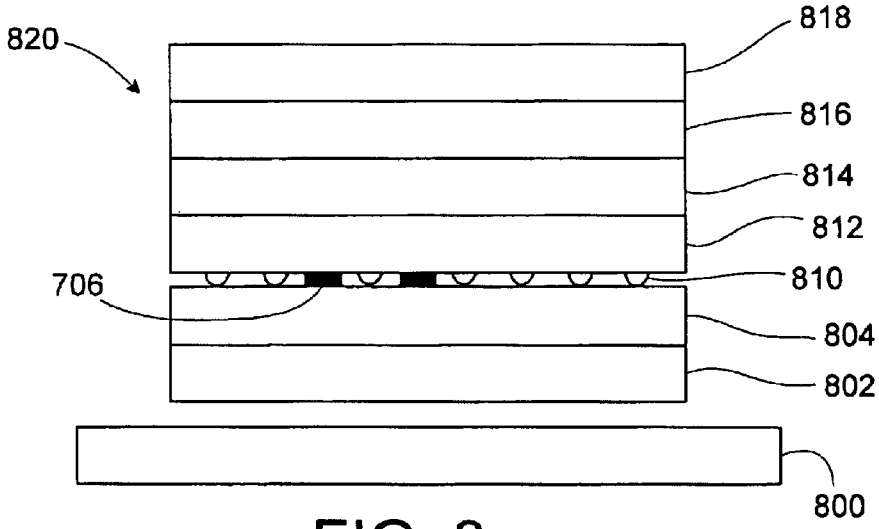
FIGS. 8*a*–8*b* are schematic illustrations of the side view of an alternative embodiment of a livestock identification tag assembly, wherein a discontinuous layer of a radiation curable adhesive is applied to the lower surface of the heat-activatable layer.
Figure 8B:
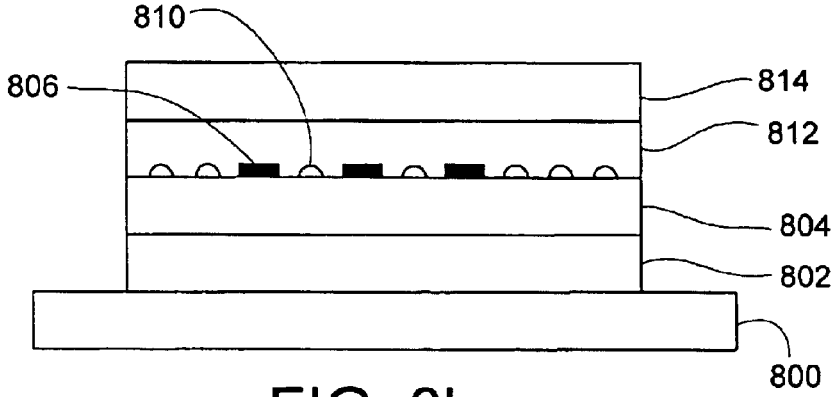

In another embodiment, illustrated in FIGS. 8*a* and 8*b*, laminate 820 is comprised of heat-activatable layer 812 adhered to transparent facestock layer 814. Laminating adhesive 816 adheres carrier layer 818 to facestock layer 814. A discontinuous layer of radiation curable adhesive 810 is applied to the bottom surface of heat-activatable layer 812. This discontinuous layer of radiation curable adhesive 810 holds pigmented layer 804 on to the heat-activatable layer 812. The radiation curable adhesive may be applied in a discontinuous pattern or may be comprised of small dots of adhesive. Pigmented layer 804 has been printed with indicia 806 and adhered to heat-activatable layer 802. Upon the application of heat and pressure to the carrier layer 818, heat-activatable layer 812 bonds to substrate 800 and encloses heat-activatable layer 802, pigmented film 804 and covers discontinuous radiation curable layer 810. The finished article, as shown in FIG. 8*b* comprises transparent facestock 814 adhered to pigmented film 804 with identifying indicia 806 by heat-activatable layer 812 around the perimeter of radiation curable adhesive 810. Pigmented layer 804 is adhered to substrate 800 by heat-activatable layer 802.

Figure 9A:
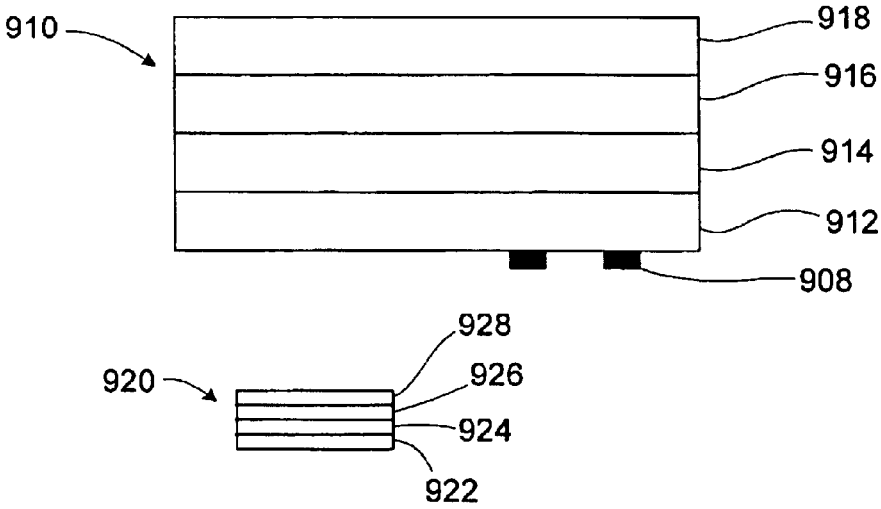
FIGS. 9*a*–9*c* illustrate an alternative embodiment of a livestock identification tag assembly in which two laminate structures are applied to the substrate.
Figure 9B:
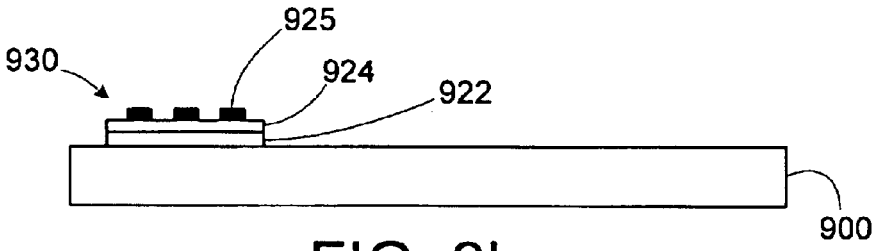
Figure 9C:
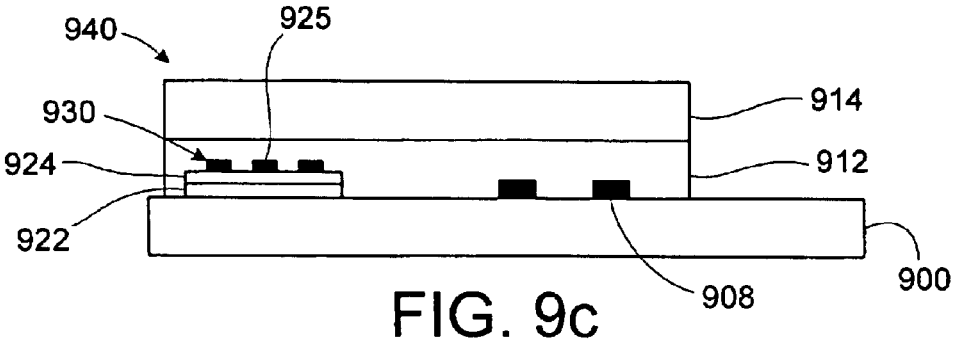

In another embodiment, illustrated in FIGS. 9*a*–9*c*, a two component laminate is used to make the identification tag assembly. Referring to FIG. 9*a*, laminating component 910 comprises heat-activatable adhesive layer 912, transparent facestock 914 overlying heat-activatable adhesive layer 912, laminating adhesive layer 916 overlying facestock 914 and carrier layer 918 adhered to laminating adhesive layer 916. Heat-activatable layer 912 may have print indicia 908 on its lower surface. Inner laminating component 920 comprises printable facestock 924, heat-activatable adhesive layer 922 adhered to printable facestock 924 and carrier layer 928 adhered to printable facestock 924 by laminating adhesive 926. Printable facestock 924 may be transparent or may be pigmented.

The method of making identification tag assembly 940 involves applying inner laminating component 920 to substrate 900 by applying heat and pressure to carrier 928, and then removing carrier 928 and laminating adhesive 926 from the substrate. As shown in FIG. 9*b*, inner laminate 930 is bonded to substrate 900 and comprises heat-activatable adhesive 922 and printable facestock 924. Data or identifying indicia 925, such as a bar code, may then be printed into the upper surface of printable facestock 924. As shown in FIG. 9*c*, laminating component 910 is then placed over substrate 900 and over inner laminate 930 and heat and pressure is applied to carrier layer 918. Heat-activatable layer 912 bonds to substrate 900 and encloses inner laminate 930. Carrier layer 918 and laminating adhesive 916 are then removed. Additional identifying indicia 908 may be printed onto substrate 900 prior to the application of component 910, or such additional identifying indicia may be printed onto heat-activatable adhesive layer 912 prior to the application of component 910. The finished identification tag assembly, identified as 940 in FIG. 9*c*.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A livestock identification tag assembly comprising:

(a) a heat seal laminate comprising:

(i) a first facestock having an upper surface and a lower surface;

(ii) a heat-activatable layer having an upper surface and a lower surface, wherein the upper surface of the heat-activatable layer is adhered to the lower surface of said facestock; and (b) a flexible polymeric substrate, having an upper surface; wherein the lower surface of the heat-activatable layer of the laminate is bonded to the upper surface of the substrate;

(c) identifying indicia positioned between the heat-activatable layer and the flexible substrate; and (d) a carrier layer overlying the upper surface of the first facestock.

2. The livestock identification tag assembly of claim 1 wherein said facestock comprises a single-layered construction.

3. The livestock identification tag assembly of claim 1 wherein said facestock comprises a multi-layered construction.

4. The livestock identification tag assembly of claim 1 wherein said facestock comprises a polymeric film.

5. The livestock identification tag assembly of claim 1 wherein said facestock comprises a polyvinyl chloride film.

6. The livestock identification tag assembly of claim 1 wherein said heat-activatable layer comprises a heat-activatable adhesive or thermoplastic film selected from the group consisting of polyolefins, polyamides, polyester copolymers, polyurethanes, ionomers based on sodium or zinc salts of ethylene methacrylic acid, polyacrylonitriles, ethylene-vinyl acetate copolymers, ethylene methacrylic acid, ethylene methyl acrylate, ethylene acrylic acid, ethylene ethyl acrylate and mixtures of two or more thereof.

7. The livestock identification tag assembly of claim 1 wherein the substrate is comprised of polyurethane.

8. The livestock identification tag assembly of claim 1 wherein the identifying indicia comprises a printed layer on the lower surface of said heat-activatable layer.

9. The livestock identification tag assembly of claim 1 wherein the identifying indicia comprises a printed layer on the upper surface of the substrate.

10. The livestock identification tag assembly of claim 1 wherein the carrier layer is adhered to the upper surface of the facestock by a laminating adhesive layer.

11. The livestock identification tag assembly of claim 1 wherein the heat seal laminate further comprises a second facestock layer having an upper and lower surface, wherein the lower surface of the second facestock layer is bonded to the upper surface of the substrate, and wherein the first facestock overlies the second facestock layer and the heat-activatable layer is adhered to the second facestock layer.

12. The livestock identification tag assembly of claim 11 wherein the heat seal laminate further comprises a radiation curable adhesive layer overlying the second facestock layer.

13. The livestock identification tag assembly of claim 11 wherein the upper surface of said second facestock layer is imprinted with identifying indicia.

14. The livestock identification tag assembly of claim 13 wherein identifying indicia, different from the identifying indicia printed on the second facestock, is positioned on the upper surface of the substrate.

15. The livestock identification tag assembly of claim 11 wherein the said second facestock layer is bonded to the upper surface of the substrate by a second heat-activatable layer.

16. A heat seal laminate comprising:

a facestock having an upper surface and a lower surface;

a heat-activatable layer adhered to said lower surface of said facestock;

a laminating adhesive overlying said upper surface of said facestock;

a carrier layer adhered to said laminating adhesive;

the heat-activatable layer having an upper surface and a lower surface, the upper surface of the heat activatable layer being adhered to said lower surface of said facestock;

a detack layer having an upper surface and a lower surface, the upper surface of said detack layer adhered to the lower surface of the heat-activatable layer; and a layer of ink or graphics printed on the lower surface of said detack layer.

* * * * *